United States Patent [19]

Farcasiu et al.

[11] 4,046,668

[45] Sept. 6, 1977

[54] DOUBLE SOLVENT EXTRACTION OF ORGANIC CONSTITUENTS FROM TAR SANDS

[75] Inventors: Malvina Farcasiu, Princeton; Darrell Duayne Whitehurst, Titusville, both of N.J.

[73] Assignee: Mobil Oil Corporation, New York, N.Y.

[21] Appl. No.: 648,597

[22] Filed: Jan. 12, 1976

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 1,904,521 | 4/1933 | Pier et al. | 208/11 LE |
| 2,453,060 | 11/1948 | Bauer et al. | 208/11 LE |
| 3,392,105 | 7/1968 | Poettmann et al. | 208/11 LE |
| 3,459,653 | 8/1969 | Benson | 208/11 LE |
| 3,475,318 | 10/1969 | Gable et al. | 208/11 LE |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

Extraction of hydrocarbons from tar sands with a light naphtha/methanol solvent system results in rapid decrepitation of the tar-sand aggregate and separation of organic matter into three phases. Distribution of the extracted and non-extracted organic material is among the phases. The most desirable, non-polar organic materials are recovered from the light naphtha phase; more polar soluble constituents are recovered from the methanol phase; and less desirable asphaltenes separate as a precipitate.

7 Claims, No Drawings

DOUBLE SOLVENT EXTRACTION OF ORGANIC CONSTITUENTS FROM TAR SANDS

BACKGROUND OF THE INVENTION

1. Field of the Invention

This invention relates to a process wherein a double-solvent treatment is used for the selective recovery of hydrocarbons and organic materials from tar sands. The process of this invention is particularly adapted to separate such hydrocarbons and organic constituents, hereinafter referred to as organic constituents, from aggregates in which mineral particles are discrete and comprise the major portion of the naturally-occurring aggregate, in order to recover virtually solid-free materials which may be further treated in standard refinery operations. It is to be distinguished from those treatment of natural asphalt in which only coarest particles of sand or minerals are removed, leaving finely divided clays or other minerals in the extract. The process is also to be distinguished from treatments for the recovery of oil from consolidated materials, such as shale. According to the process of this invention, hydrocarbons and organic materials are selectively extracted from tar sands by a mixture of light naphtha and methanol. The extraction results in rapid collapse of the aggregate and the simultaneous separation of the mixture into three phases, which separation is brought about by trace amounts of water. The most desirable, non-polar components of the extract are recovered from the naphtha phase; more polar soluble components are recovered from the methanol phase; and the majority of the less desirable asphaltenes remain insoluble but are separated from the sand and are found at the interface of the two solvents. These asphaltenes may be recovered from the interface or may be removed by filtration of the lower methanol layer through the sand.

2. Description of the Prior Art

As sources of crude oil become less available, there is a greater need to develop known but less easily handled petroleum resources. One such resources is tar sand, a sandy material having both water and tar within its interstices. Large deposits are found in various parts of the world. For example, one of the largest known deposits of tar sands lies in the Athabasca district of Alberta Canada, and extends for many thousands of square miles.

These sands contain tremendous reserves of hydrocarbon constituents. For example, the oil in the sands may vary from about 5 to 21% by volume, generally in the range of about 12% by volume. The gravity of the oil ranges from about 6° to 10° API, generally about 8° API. The tar sand beds may range from about 100 to 400 feet thick, covered by an overburden from about 200 to 300 feet. A typical oil recovered from the sands has an initial boiling point of about 300° F., 1.0% distillation to 430° F., 20% distillation to 650° F., and 50.0% distillation to 980+ F. Tar sands represent a significant petroleum resource which may ease the growing shortage of sources available to satisfy our petroleum demand. However, before the petroleum material in the tar sand can be employed in ordinary oil refining operaton, it must be separated from the solid, sandy material.

Thus, tar sands suffer the disadvantage of requiring additional processing steps over conventional forms of oil recovery. The high cost of separating tar from sand has been the greatest restriction on the use of tar sand as an economical source of crude petroleum. It is, therefor, essential to the commercial feasibility of any process for the recovery of hydrocarbons from tar sands that its costs be low while maintaining a high recovery of hydrocarbons.

The peculiar nature of the tar sand aggregate has heretofore frustrated atempts to attain these goals, though, some are relatively soft and free-flowing while others are very hard and rocklike. For example, the tar sands of the Athabasca district are composed of an almost pure silica sand, each grain of which is surrounded by a layer of water which, in turn, is surrounded by a film of oil. The oil film may also contain significant quantitites of clay. The interstices between the grains are largely filled with oil. This construction of the aggregate is believed to exist because the water content of the tar sands has a greater surface tension than the oil. Although, it is recognized that the exact compositions of the tar sands vary, even in an immediate location, the foregoing construction of the tar sand aggregate is apparently a general characteristic of the sands.

Various methods have been prepared for the recovery of hydrocarbons from tar sands, including direct fluid coking and retorting. These thermal processes are uneconomical due to the fact that the heat imparted to the sand cannot be effectively and efficiently recovered therefrom. Accordingly, attention has more recently focused on solvent extraction as a general method which may provide a commercially feasible process for the treatment of tar sands.

U.S. Pat. No. 2,825,677 disclosed a two-stage process wherein a hydrocarbon diluent, having a lesser specific gravity than that of the tar-sand oil, is first added to the sand to dilute the oil phase and reduce its viscosity, thereby making it more mobile and susceptible to the stopping forces of the aqueous phase. The specific gravity of the oil phase is reduced to a point below that of the aqueous phase to facilitate separation. In the first stage, a hydrocarbon diluent, such as benzene, toluene, gasoline, coal tar naptha, or petroleum naptha is employed. In the second stage, large quantities of water (2 volume of water per volume of oil) are added and the combined mass is subjected to a pressure separation, preferably centrifugation. This method is inadequate because of the large quantities of water required and the formation of oil-water emulsions which are very difficult to break. A smiliar water/hydrocarbon-diluent process is also disclosed in U.S. Pat. No. 3,553,098.

A non-aqueous recovery process is disclosed in U.S. Pat. No. 3,131,141, which process may be also characterized as a two-stage method since the tar sand is subject to contact with a series of solvents. The initial solvent contacting stage employs a light gas oil boiling within the range from about 400° to 700° F. to segregate a bitumen-gas oil phase and sand-gas oil phase. The separated sand-gas oil phase is then contacted with a liquified, normally gaseous hydrocarbon, preferably propane or butane, to separate a sand-liquified, normally gaseous hydrocarbon phase. Further separation steps produce sand, gas oil, and liquified, normally gaseous hydrocarbon. This process, while achieving good recoverey of the two solvents employed for extraction, has a relatively low rate of extraction and requires heat and pressure to effect the desired separations.

Sands with solvent recovery by steam stripping the separated sand is disclosed in U.S. Pat. No. 3,475,318. Prior methods has taught the complete removal of tar from the sand, but it was recognized that complete removal may be disadvantageous in that additional processing steps are required when refining the extracted tar to obtain the desired oil products. Specifically, the extracted tar must go through a flash distillation step in which indesirable oil products could selectively be removed from the tar sands, leaving the undesirable asphaltenes on the sand, by solvent extraction with a solvent consisting of a saturated hydrocarbon or mixture of saturated hydrocarbons having from 5 to 9 carbon atoms per molecule. Recognizing that it may be desirable to remove a certain portion of asphaltenes from the tar sand to use as fuel for the process, U.S. Pat. No. 3,475,318 further discloses the use of a controlled amount of an aromatic solvent having from 6 to 9 carbon atoms per molecule to extract the desired amount of asphaltenes. U.S. Pat. No. 3,079,326 discloses a double-solvent system (i.e., naphtha/methanol) for fractionating tar products obtained from low-temperatures pyrolysis of coal. The methanol solvent emloyed is an aqueous solution containing from 20 to 60 percent water which is used in a ratio varying from 0.5 to 2.0 volumes per volume of coal tar.

SUMMARY OF THE INVENTION

An object of the present invention is to provide an economical process for the selective extraction of desirable organic constituents from tar sand. A further object is to provide such a process which minimizes energy, equipment, and water requirements and maximizes extraction yield, rate of extraction, and separation properties of the post-extraction system.

The extraction of organic constituents from tar sands according to the process of the present invention is accomplished by a double-solvent system of light naphtha and methanol. The addition of heat to the extraction zone is not normally required because the extraction temperature may be as low as about 50° F. Rapid decrepitation of the tar sand aggregate occurs, followed by separation of two layers of solution. The heavy asphaltenes are partitioned between the interface of the two solutions and on the fluid surface. Further product separation of the liquid layers following extraction of hydrocarbons and organic materials from the tar sand is a unique feature of this process. Depending on the water content of the tar sand, the separation may occur simultaneously with the extraction or may be accomplished by the addition of a small quantity of water, at least about 1 percent to the binary extract. After removal of the upper, light naphtha fraction by decantation, the major portion of the methanol fraction is separately withdrawn. The remaining portion is filtered through the sand. This deposits all of the asphaltenes on the sand. The light naphtha fraction is separated to avoid filtration thereof through the sand. The methanol fraction is much easier to filter than the whole binary mix.

While not wishing to be bound by any specific theory of operability, it is believed that the effectiveness of the double-solvent system of the invention is based on the ability of methanol to penetrate the water layer surrounding the sand grains of the tar sand aggregate. By contrast, it is known that a solvent, such as hexane works ineffectively in a water system and penetration of the aggregate water layers by such a solvent is difficult. The methanol penetration of the water layer is beneficial in reducing the interfacial tension between the double solvent/tar-sand oil phase and the solid phase so that the fine sand grains separate more readily from the hydrocarbon organic matter phase.

Moreover, the separation of the binary solvent/tar-sand oil mixture into a light naphtha phase and a methanol phase and a methanol phase results in a favoravble distribution of the extracted hydrocarbons organic matter between the phases, in addition to improving the performance of the later filtration step. The most desirable, non-polar components of the extracted constituents are recovered from the light naphtha phase, the more polar, soluble constituents are recovered from the methanol phase and the less desirable asphaltenes are withdrawn with the sand.

The solid asphaltenes deposited on the surface of the sand may also be recovered. For example, the sand fraction with deposited asphaltenes may be combusted or burned with oxygen containing gas and thus used as source of energy for the process. Alternatively, the asphaltenes deposited on the sand surface may be further recovered as by extraction by an aromatic solvent. Aromatic compounds especially effective for such further extraction are aromatics benzene and pyridine. Alternatively, the majority of the asphaltenes may be recovered be decantation or other method of withdrawal of oil liquids followed by filtration to remove entrained asphaltene particles.

An important aspect of the present invention is the ease with which the particular duel solvents may be recovered due to the large differences in the boiling point between the solvents, the respective extracts and the good filtration properties of the methanol layer.

Thus, the present invention has the advantage of providing deasphalting and extraction in one step, which eliminates or greatly simplifies a subsequent distillation step in which undesired asphaltenes are removed. The process also has the advantage of not forming difficult to separate water-oil emulsions as found in the recovery of tar-sand hydrocarbons by addition of large quantities of water. Additionally, some tar sands deposits occur in locations where water resources are scarce. If such is the case, the double-solvent extraction method of this invention can be considered as a method of extracting organic constituents from tar-sand aggregate at the mine site. Finally, a light naphtha/methanol solvent system is much less expensive to operate than conventional aromatic solvents processes by virtue of the lower initial cost of the solvents and the ease with which the solvents may be recovered from their respective extracts.

DESCRIPTION OF PREFERRED EMBODIMENTS

The light naphtha solvent employed in the process of this invention is a hydrocarbon or a mixture of hydrocarbons having from 5 to 9 carbon atoms per molecule. Although the light naphtha will usually predominantly comprise straight-chain paraffins, the light naphtha may also comprise naphthenes and branched paraffins. The boiling point of the light naphtha may vary from about 20° to 200° C. However, the boiling point will preferably range from about 40° to 100° C. Preferable naphthas comprise straight run naphtha or petroleum ether, alkylates and raffinate product of Udex extraction.

A suitable amount of light naphtha/methanol solvent for extracting hydrocarbons and organic constituents from tar sand may vary from about 1 to 10 volumes of solvent per volume of tar sand. The volume ratio of light naphtha to methanol in the solvent system may vary, depending on the characteristics of the particular tar sand to be processed. Specifically, the ratio should be roughly equal to the ratio of light naphtha extract to methanol extract which is recovered from the tar sand. In a preferred embodiment of this invention however, the light naphtha/methanol ratio ranges from 60/40 to 70/30. Broad range 50/50 to 80/20.

A comparison of the extraction rates of various solvent systems demonstrated the following relationships: MeOH << light naphtha < 50/50 benzene MeOH < 70/30 light naptha/methanol = benzene. Thus, the extraction rate of the light naphtha/methanol solvent system is greater than either of the two components alone and comparable with benzene. However, the quality of extracts is considerably higher with the 70/30 light naphtha/methanol system than with the benzene system, as shown by the following Examples.

EXAMPLE 1

An Oil Creek Oklahoma tar sand (45 grams) was mixed with 150 cc of 70/30 light naphtha/methanol solvent. A solid, sand fraction immediately separated from the mixture, and, after the addition of about 0.5 to 1 percent water to the solvent/tar-sand oil mixture, two liquid fractions formed; a light naphtha fraction and a methanol fraction. The light naphtha fraction was decanted from the extraction vessel and distilled to separate the light naphtha from its extract. The methanol fraction was then separated from the solids. Although the separation method of this example is filtration, it should be understood that other methods which are well-known in the art, such as centrifugation, may also be employed to separate the methanol fraction from the solids. Following this separation, the methanol fraction was distilled to separate the methanol from its extract. Both the distilled light naphtha and methanol may be reused in the extraction step. The total extracted organic material yield of this example was found to be 4.9% by weight of the tar sand treated. This value compares favorably with the 4.8% yield obtained by benzene extraction of the same tar sand.

Table 1 shows the elemental analysis of the various extracts of the example. Examination of Table 1 will reveal the favorable distribution of heteroatoms among the fractions obtained by the solvent extraction method of the invention.

TABLE 1

ELEMENTAL ANALYSIS OF OIL CREEK OKLAHOMS EXTRACTS

| | %C | %H | %N | %S | %O | % of Total |
|---|---|---|---|---|---|---|
| Benzene extract | 84.8 | 10.6 | 0.6 | 2.26 | 1.6 | — |
| Light naptha extract | 85.7 | 11.2 | 0.46 | 2.5 | — | 44 |
| Methanol extract | 83.4 | 10.3 | 0.55 | 1.9 | 3 | 21 |
| Solid | 80.6 | 8.7 | 1.1 | 2.8 | 6 | 35 |

EXAMPLES 2-3

Extraction yields of 70/30 light naphtha/methanol and of benzene from Utah and Athabasca tar sands are shown in Table 2.

TABLE 2

| | EXTRACTION YIELD | | | |
|---|---|---|---|---|
| | 70/30 Light naphtha/MeOH | | Benzene | |
| Fractin | Utah | Athabasca | Utah | Athabasca |
| Light naphtha | | 6.0 | | |
| MeOH | | 2.5 | | |
| Total extracted | 10.2 | 8.5 | | |
| Non-extracted asphaltenes | 1.8 | 2.1[2] | | |
| TOTAL | 12.0 | 10.6 | 12[2] | 10.6 |

[1]grams/100 grams tar sand
[2]estimatd vaue

From the foregoing description, it is evident that the present invention provides a process for separating organic constituents from tar sand that is efficient and economical, and one that does not entail high losses of valuable materials. Of particular importance is the fact that the relatively simple equipment, energy and water requirements of the process of the invention make it feasible to separate organic constituents from tar sand at the mine site. This is an important economical factor in any process for recovering organic constituents from tar sand. Thus, by means of the present invention, tar sand can be mined, organic constituents selectively removed therefrom, the sand returned to fill the mining site, and only the organic constituents recovered from the process need be shipped for further processing.

What is claimed is:

1. A process for recovering hydrocarbons from tar sand which comprises:
   A. mixing tar sand with a solvent mixture of light naphtha comprising $C_5$ to $C_9$ carbon atoms per molecule and methanol to produce a light naphtha fraction with solublized non-polar components, a methanol fraction with solublized polar components and a solid sand fraction with accumulated asphaltenes on the sand surface;
   B. separating by decanting said light naphtha fraction from said methanol fraction,
   C. separating said methanol fraction from said solid, sand fraction, and
   D. separating and recovering polar and non-polar components from said separated solvent mixture components.

2. The process of claim 1, wherein said light naphtha/methanol solvent mixture is composed of 70 vol. % of light naphtha and 30 vol. % of methanol.

3. The process of claim 1, wherein said methanol fraction is separated from the sand and accumulated asphaltenes by filtration.

4. The process of claim 1, wherein sand comprising deposited asphaltenes is combusted and used as a source of energy.

5. The process of claim 1, wherein asphaltenes accumulated with said sand are extracted with an aromatic solvent.

6. The process of claim 5 wherein said aromatic solvent is pyridine.

7. The process of claim 5 wherein said aromatic solvent is gamma-picoline.

* * * * *